US008646238B2

(12) United States Patent
Gulbrandsen

(10) Patent No.: US 8,646,238 B2
(45) Date of Patent: Feb. 11, 2014

(54) APPARATUS, SYSTEM, AND METHOD FOR FACILITATING USE OF THIN FLEXIBLE SCRIMS IN A GRID-TYPE SUSPENDED CEILING

(75) Inventor: Peder J. Gulbrandsen, Aurora, IL (US)

(73) Assignee: USG Interiors, LLC, Chicago, IL (US)

( * ) Notice: Subject to any disclaimer, the term of this patent is extended or adjusted under 35 U.S.C. 154(b) by 0 days.

(21) Appl. No.: 13/334,092

(22) Filed: Dec. 22, 2011

(65) Prior Publication Data

US 2013/0160386 A1 Jun. 27, 2013

(51) Int. Cl.
*E04B 1/82* (2006.01)
*E04B 9/00* (2006.01)

(52) U.S. Cl.
USPC ..... 52/506.06; 52/144

(58) Field of Classification Search
USPC ..... 52/506.06–506.09, 144
See application file for complete search history.

(56) References Cited

U.S. PATENT DOCUMENTS

| | | | | |
|---|---|---|---|---|
| 3,418,766 | A * | 12/1968 | Jackson | 52/83 |
| 4,026,081 | A * | 5/1977 | Delaney et al. | 52/222 |
| 4,161,977 | A * | 7/1979 | Baslow | 160/381 |
| 5,123,225 | A * | 6/1992 | Goodworth | 52/506.08 |
| 5,182,893 | A * | 2/1993 | Goodworth | 52/745.05 |
| 5,214,892 | A * | 6/1993 | Livingston et al. | 52/222 |
| 5,275,224 | A * | 1/1994 | Morris | 160/327 |
| 6,499,262 | B1 * | 12/2002 | Pinchot et al. | 52/273 |
| 6,722,096 | B2 * | 4/2004 | Von Arx et al. | 52/511 |
| 7,096,633 | B1 * | 8/2006 | Bowen | 52/506.06 |
| 7,607,268 | B2 * | 10/2009 | Scherrer et al. | 52/273 |
| 7,765,762 | B2 * | 8/2010 | Gulbrandsen et al. | 52/506.09 |
| 7,908,813 | B2 * | 3/2011 | Gulbrandsen et al. | 52/506.09 |
| 7,926,237 | B2 * | 4/2011 | Gerkes et al. | 52/506.03 |
| 7,954,293 | B2 * | 6/2011 | Nielsen | 52/506.01 |
| 2005/0166506 | A1 * | 8/2005 | Morelissen et al. | 52/506.06 |
| 2006/0005495 | A1 * | 1/2006 | Stessel et al. | 52/506.07 |
| 2006/0179765 | A1 * | 8/2006 | Howard et al. | 52/506.07 |
| 2006/0254205 | A1 * | 11/2006 | Swiszcz et al. | 52/793.1 |
| 2008/0066394 | A1 * | 3/2008 | Nielsen | 52/83 |
| 2009/0173030 | A1 * | 7/2009 | Gulbrandsen et al. | 52/506.09 |
| 2010/0269444 | A1 * | 10/2010 | Gulbrandsen et al. | 52/506.09 |
| 2011/0252736 | A1 | 10/2011 | Eisner et al. | |

FOREIGN PATENT DOCUMENTS

| | | | |
|---|---|---|---|
| DE | 20 2005 004670 | U1 | 6/2005 |
| WO | 2008/153993 | A1 | 12/2008 |

OTHER PUBLICATIONS

Notification of Transmittal of the International Search Report and the Written Opinion of the International Searching Authority, or the Declaration of PCT/US2012/069144, filed Dec. 12, 2012, International Search Report and Written Opinion dated Apr. 9, 2013.

* cited by examiner

*Primary Examiner* — Joshua J Michener
*Assistant Examiner* — Elizabeth A Plummer
(74) *Attorney, Agent, or Firm* — Pearne & Gordon LLP

(57) ABSTRACT

Ceiling panels for use in a grid-type suspended ceiling (10) each comprise a thin flexible scrim (40) that is of insufficient rigidity to consistently maintain a substantially planar form when installed in the grid-type suspended ceiling. These embodiments also present a rigidizing and engagement member (60, 122, 161) that attaches to only a relatively minor portion of the thin flexible scrim and that is configured and arranged to substantially increase and maintain rigidity of the thin flexible scrim such that the thin flexible scrim will consistently maintain a substantially planar form when installed in the grid-type suspended ceiling and that will also serve to engage at least one grid runner of the grid-type suspended ceiling to thereby maintain the thin flexible scrim in an installed position within the grid-type suspended ceiling.

6 Claims, 6 Drawing Sheets

APPARATUS, SYSTEM, AND METHOD FOR FACILITATING USE OF THIN FLEXIBLE SCRIMS IN A GRID-TYPE SUSPENDED CEILING

TECHNICAL FIELD

This invention relates generally to grid-type suspended ceilings.

BACKGROUND

Suspended ceilings of various types are known in the art. This includes grid-type suspended ceilings. Suspended ceilings, sometimes also known as a drop or dropped ceiling, typically serve as a secondary ceiling formed to conceal piping, wiring, ductwork, and other exposed construction elements in an area called the plenum. Such ceilings typically consist of a grid-work of spaced grid runners that often have the shape of an upside-down "T" that are suspended on wires from the overhead structure. These channels snap together in a regularly spaced pattern to form corresponding ceiling panel regions.

These ceiling panel regions each typically serve to receive a single ceiling panel (also sometimes known as ceiling tiles) which often simply drop into the grid. Such ceiling panels are supported by the T-shaped grid runners. These ceiling panels themselves usually stay in place and consistently maintain a substantially planar form factor, once installed, given their own inherent rigidity. Present offerings in this regard are suitable for a wide range of application settings. There are some application settings, however, where such is not always the case.

For example, there are instances when additional components employed in such a ceiling, such as acoustic batting, negate a need for an exposed ceiling panel that offers much beyond an aesthetically pleasing visage. In such a case, existing approaches that emphasize the use of rigid ceiling panels can lead to undesirable expense due to the inherent cost of such panels.

SUMMARY OF THE INVENTION

Pursuant to the various exemplary preferred embodiments, ceiling panels for use in a grid-type suspended ceiling each comprise a thin flexible scrim that is of insufficient rigidity to consistently maintain a substantially planar form when installed in the grid-type suspended ceiling. These embodiments also present a rigidizing and engagement member that attaches to only a relatively minor portion of the thin flexible scrim and that is configured and arranged to substantially increase and maintain rigidity of the thin flexible scrim such that the thin flexible scrim will consistently maintain a substantially planar form when installed in the grid-type suspended ceiling and that will also serve to engage at least one grid runner of the grid-type suspended ceiling to thereby maintain the thin flexible scrim in an installed position within the grid-type suspended ceiling.

Pursuant to one exemplary embodiment, the rigidizing and engagement member can comprise a beam having a kerf formed in opposing ends thereof. When secured to the thin flexible scrim, these kerfs can serve to receive a corresponding portion of a grid runner to thereby aid in retaining the resultant ceiling panel in an installed position even as the beam itself lends sufficient rigidity to the scrim to thereby maintain the scrim in a substantially planar form following installation.

Pursuant to another exemplary embodiment, the rigidizing and engagement member can comprise a corner piece that engages folded-up walls of the scrim to thereby aid in retaining such walls in a deployed manner. When so retained by the corner piece, these walls provide the desired amount of rigidity. In addition, such a corner piece can be configured and arranged to interact with the grid runners to thereby again serve to maintain the ceiling panel in an installed position. By one approach in this regard, such a corner piece can be configured and arranged to extend outwardly of the perimeter of the scrim in order to rest upon a corresponding grid runner surface. By another approach in this regard, such a corner piece can have one or more notches that serve to receive a corresponding part of the grid runner in order to thereby support the scrim from that grid runner.

So configured, very thin and quite flexible scrims can be employed in place of traditional ceiling panels. This can contribute greatly to a significantly reduced cost for such a component. Those skilled in the art will also understand and appreciate that these embodiments are readily and easily accommodated at the worksite and hence can contribute to an efficient and speedy installation process. This, in turn, also contributes greatly to yielding a highly cost-effective approach. Those skilled in the art will also appreciate that these embodiments are highly scalable and can be employed with a wide variety of differently sized and differently shaped ceiling panels. It will also be noted that these embodiments will accommodate ready removal of an installed panel, thereby preserving an important design feature of such a component.

DETAILED DESCRIPTION OF THE PREFERRED EMBODIMENTS

Figure 1:
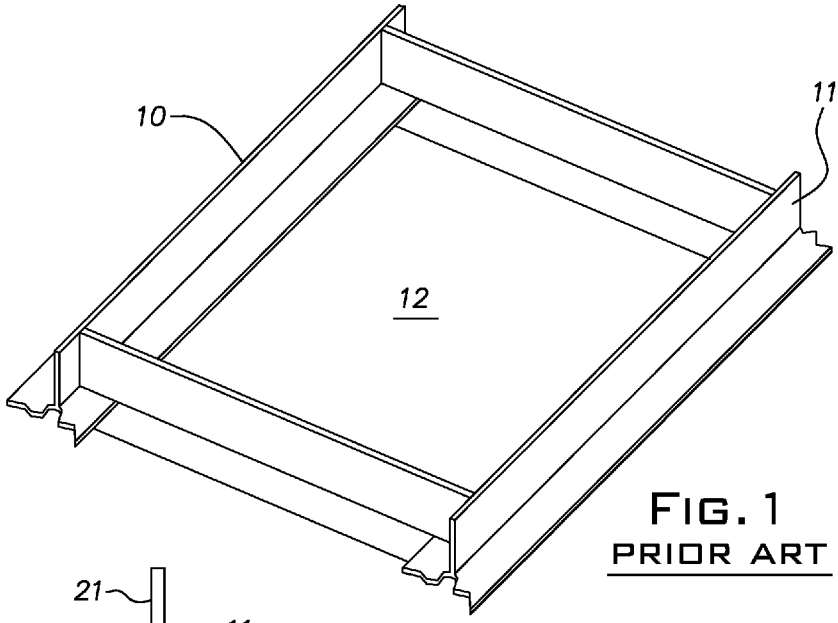
FIG. 1 PRIOR ART
FIG. 1 comprises a perspective cutaway view of a portion of a ceiling system as configured in accordance with the prior art.
Figure 2:
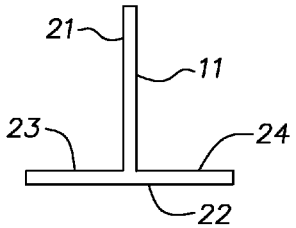
FIG. 2 PRIOR ART
FIG. 2 comprises a side elevational view of a grid runner as configured in accordance with the prior art.

These and other benefits may become clearer upon making a thorough review and study of the following detailed description. Referring now to the drawings, and in particular to FIGS. 1 and 2, it may be helpful to first briefly describe and characterize a grid-type suspended ceiling 10. Such a ceiling 10 is typically comprised of a plurality of spaced grid runners 11 that are joined one to the other in a manner that defines a plurality of ceiling panel regions 12. These grid runners 11 often have an inverted "T" shaped cross-section that comprises a vertical member 21 and a horizontal member 22 having outwardly extending flanges 23 and 24. The vertical member 21 typically serves as a point of attachment by which the grid runner 11 can be suspended in place. The horizontal member 22, in turn, provides horizontal surfaces upon which ceiling panels are typically placed when installed.

Figure 3:
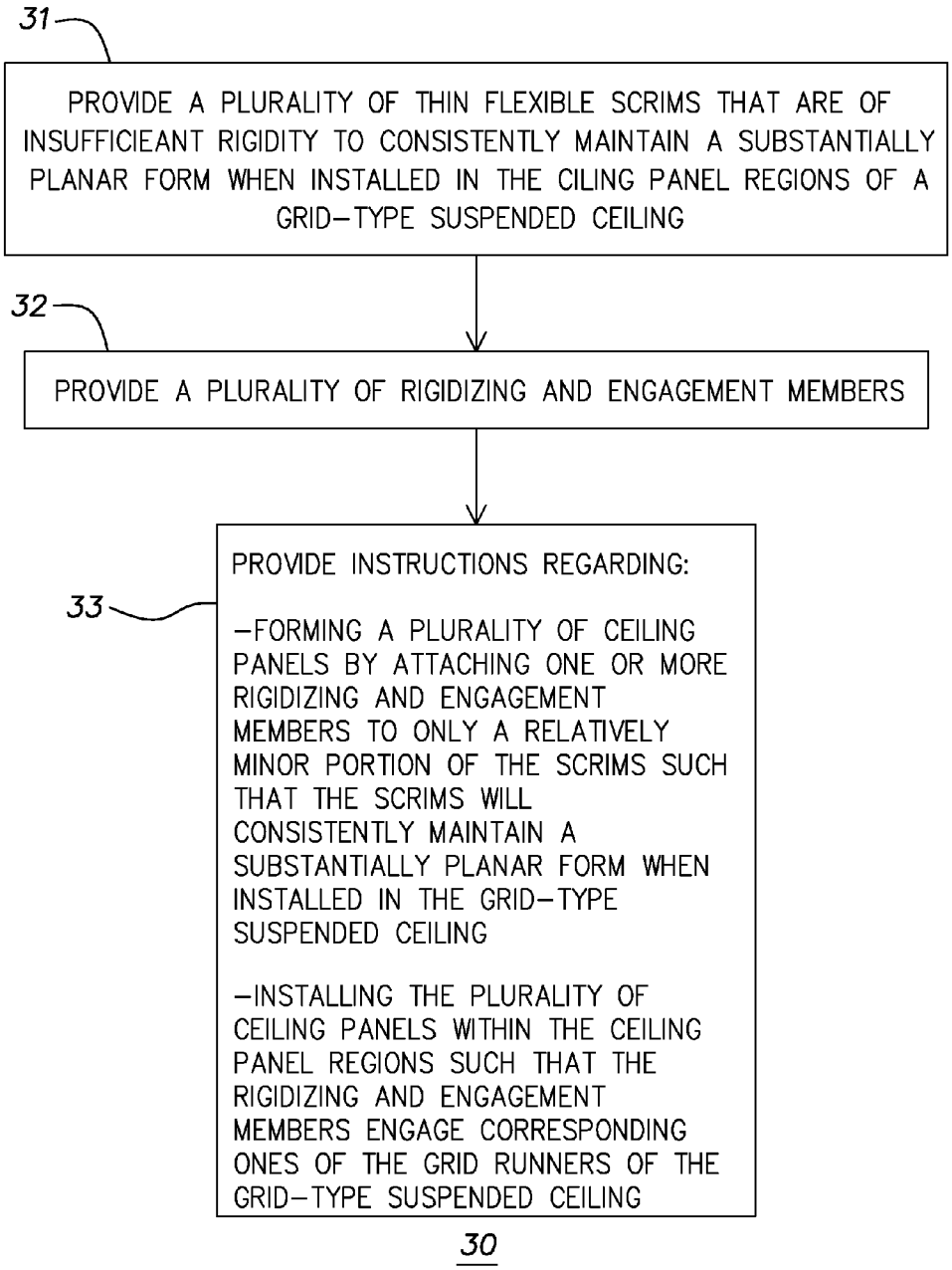
FIG. 3 comprises a flow diagram of a method to facilitate installing ceiling panels as configured in accordance with various exemplary embodiments of the invention.

Referring now to FIG. 3, an overview process 30 which accords with these teachings and embodiments will first be described. Generally speaking, this process 30 provides a method to facilitate installing ceiling panels in a grid-type suspended ceiling that comprises a plurality of spaced grid runners that define ceiling panel regions. With this in mind, this process 30 provides for provision 31 of a plurality of thin flexible scrims that are of insufficient rigidity to consistently maintain a substantially planar form when installed in the ceiling panel regions.

Figure 4:
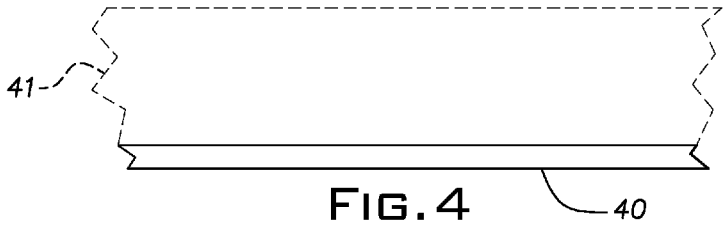
FIG. 4 PRIOR ART
FIG. 4 comprises a side elevational view of a portion of a ceiling panel as configured in accordance with the prior art.

With momentary reference to FIG. 4, a typical prior art ceiling panel often has considerable lateral strength and rigidity due, at least in part, to the inclusion of considerable sturdy bulk 41 and/or materials that exhibit such strength and rigidity as an intrinsic characteristic. The scrim 40 that provides an aesthetically appealing facade to the bottom surface of the ceiling tile typically adds little in the way of strength or rigidity in this regard. The present embodiments being disclosed herein, however, will effectively accommodate the use of what amounts to just the scrim 40 itself. The scrim 40 may be any of a variety of materials such as, for example, a woven fabric, plastic, metal mesh, to list but a few. In one exemplary embodiment, the scrim 40 has a thickness of less than 0.060.

Being thin and being comprised of relatively non-rigid material, such a scrim can be expected to sag once installed in the ceiling panel regions of a grid-type suspended ceiling. In some cases, this sagging can begin almost immediately and may become worse over time. In some cases, this sagging can reach a point where the scrim actually falls out of place and drops from the suspended ceiling. Accordingly, and referring again to FIG. 3, this process 30 also accommodates providing 32 a plurality of rigidizing and engagement members. Numerous examples and details will be provided further below in this regard.

This process 30 will then accommodate providing 33 instructions regarding the formation of corresponding ceiling panels and the installation of those ceiling panels in a grid-type suspended ceiling. Such ceiling panels can be formed, for example, by attaching at least one of the rigidizing and engagement members to only a relatively minor portion of a corresponding one of the thin flexible scrims to thereby substantially increase and maintain rigidity of the thin flexible scrim such that the thin flexible scrim will consistently maintain a substantially planar form when installed in the grid-type suspended ceiling.

The instructions regarding installation can, in turn, provide details regarding installation of the ceiling panels in a manner such that the rigidizing and engagement members engage corresponding ones of the grid runners to thereby maintain the thin flexible scrims in an installed position within the grid-type suspended ceiling. This can include, where appropriate, instructions regarding temporarily bowing the ceiling panels such that the ceiling panels will fit within the ceiling panel regions during installation. This can also include, and again as appropriate, instructions regarding specific ways by which the rigidizing and engagement members are to engage the grid runners to achieve the desired installation result.

Figure 5:
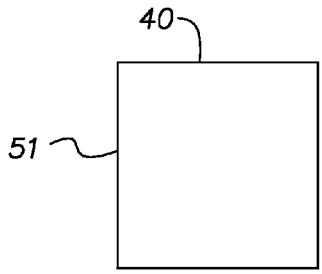
FIG. 5 comprises a plan view of a scrim as configured in accordance with various exemplary embodiments of the invention.

The described process 30 will be understood to comprise only one non-limiting example and is not to be taken as an exhaustive presentation of all manner and approaches by which these embodiments can be practiced. Beginning now with FIG. 5, additional details regarding certain embodiments will be presented.

In this embodiment, the thin flexible scrim 40 comprises a substantially rectangular shaped scrim 51. This can comprise a square shaped scrim as shown as well as any other rectangular form. Many suspended ceilings are comprised of ceiling panels having a rectangular shape and hence this choice for an illustrative embodiment here. Those skilled in the art will recognize and understand, however, that other choices are possible. In large measure, the shape of the ceiling panel comprises a function of the shape of the ceiling panel regions formed by a given grid-type suspended ceiling. The length and width dimensions of this scrim 51 can of course vary with the needs and/or opportunities as tend to characterize a given application setting.

Figure 6:
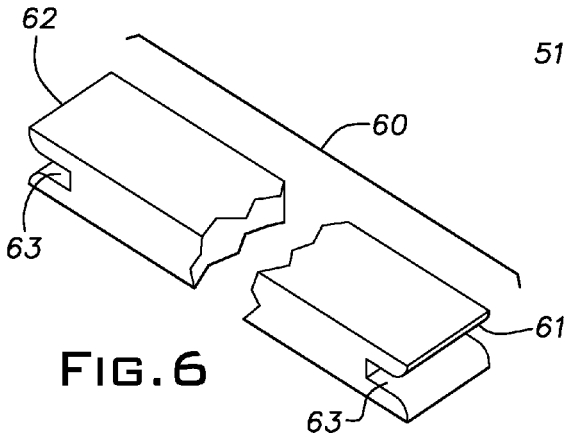
FIG. 6 comprises a perspective cutaway view of a portion of a rigidizing and engagement member as configured in accordance with various embodiments of the invention.

Referring now to FIG. 6, a rigidizing and engagement member suitable for use with such a scrim 51 can comprise a beam 60 having a first end 61 and an opposing second end 62.

In this illustrative example, each such end 61, 62 has a kerf 63 formed there. The dimensions of these kerfs 63 can be selected to accommodate engaging a corresponding grid runner (and in particular the horizontal flanges 23 and 24 as described above with respect to FIG. 2). This can at least comprise sizing the kerf 63 to readily receive such a flange. By one approach, this can also comprise sizing the kerf 63 to engage the grid runner with a compression fit to thereby aid and assist with retaining such a beam 60 in place once installed.

Figure 7:
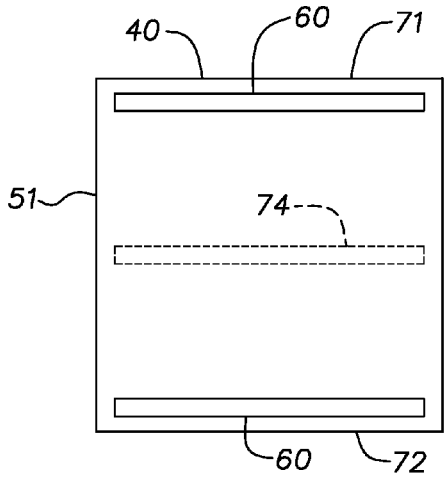
FIG. 7 comprises a plan view of a scrim as configured in accordance with various exemplary embodiments of the invention.

Referring now to FIG. 7, these teachings will then accommodate attaching one or more of these beams 60 to the above-described scrim 51. By one approach, this can comprise attaching a first such beam 60 proximal to a first edge 71 of the scrim 51 and a second such beam 60 proximal to a second, opposing edge 72 of the scrim 51. As illustrated, this can comprise disposing these beams 60 substantially parallel to one another. This can comprise, if desired, placing the beams 60 somewhat inwardly of these edges 71, 72. Such a configuration can assist with avoiding unwanted interaction between such beams 60 and nearby grid runners. These teachings also will accommodate offsetting the ends of the beam 60 as well in order to provide an overlap of the scrim 51 with respect to a point of engagement between the beam 60 and a grid runner as described below.

It would be possible as well to include additional beams 60 as desired, as suggested by the third beam shown in phantom lines and denoted by reference numeral 74. In general, however, taken alone and also, by one approach, in the aggregate, such beams 60 attach to only a relatively minor portion of the scrim 51. As shown, for example, the aggregation of two such beams 60 comprises less than ten percent of the total surface area of the scrim 51 itself. In another exemplary embodiment, the aggregation of multiple beams 60 comprises no more than 25%.

These beams 60 can be comprised of any of a variety of materials. Generally speaking, however, relatively lightweight materials may be particularly beneficial, at least for some application settings. It also may be useful to comprise these beams 60 of a flexibly resilient material. So configured, the combined scrim 51 and beam(s) 60 can be readily bowed by an installer (using, for example, only their own personal body strength) to facilitate installation of the ceiling panel in a grid-type suspended ceiling. Following such installation, of course, the combined scrim 51 and beam(s) 60 will then readily return to a substantially unbowed form. Various plastic materials, for example, will serve well in this regard. Other materials are also contemplated such as, for example, various metals, polymers, and fiberglass to list but a few.

These beams 60 can be attached to the scrim 51 using any of a wide variety of attachment techniques. Some examples include, but are not limited to, adhesives of various kinds, two-side tape, one-sided tape, hooks-and-loops fasteners, sonic welding, brads, and so forth. By one approach this attachment can occur at a point of manufacture. By another approach, the attachment can occur at (or near) the worksite where the resultant ceiling panels are to be installed.

Figure 8:
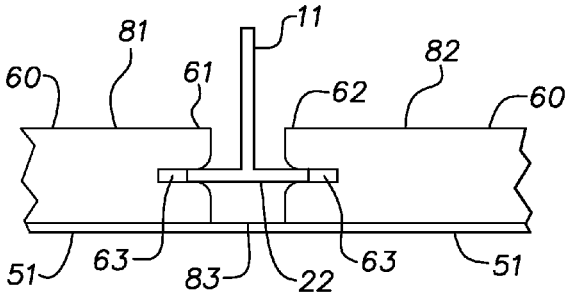
FIG. 8 comprises a side elevational view of a portion of a ceiling system as configured in accordance with various exemplary embodiments of the invention.

As noted above, the beams 60 have kerfs 63 that are sized to engage with a corresponding member of a grid runner. FIG. 8 provides an illustrative example in this regard. In this example, a single grid runner 11 serves to support two such ceiling panels 81 and 82. In particular, the lower flanges 22 of the grid runner 11 serve to engage the kerfs 63 of the beams 60 of both ceiling panels 81 and 82. As noted, this can comprise a compression fit if desired. So configured, the beams 60 are therefore seen to not only serve to add rigidity to the scrim 51 but to also serve as the means by which the resultant ceiling panel engages the grid system of the grid-type suspended ceiling, thereby serving at least these two important purposes.

As noted earlier, the ends 61 and 62 of the beams 60 can be inset from the edge of the scrim 51. FIG. 8 illustrates such a configuration. So configured, it can also be seen that the edges of both scrims 51 are allowed to abut one another once installed along a parting line 83. This, in turn, effectively hides the grid system and hence provides an appearance that many consumers find aesthetically appealing.

Figure 9:
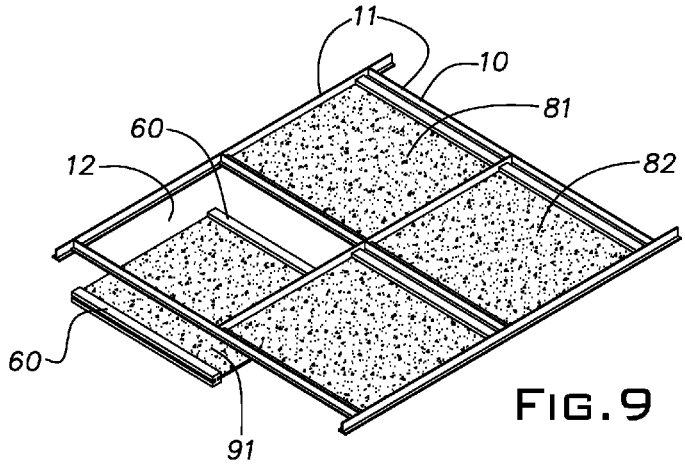
FIG. 9 comprises a perspective cutaway view of a portion of a ceiling system as configured in accordance with various exemplary embodiments of the invention.

FIG. 9 illustrates a portion of a grid-type suspended ceiling 10 having a plurality of ceiling panel regions 12 defined by the various grid runners 11. The two above-described ceiling panels 81 and 82 are shown in an installed state, while another ceiling panel 91 is shown in an about-to-be-installed state. By one approach, such an installation can comprise first temporarily bowing the ceiling panel 91 along an axis that substantially parallels the longitudinal axis of the runners in order to ease the introduction of the ceiling panel 91 into the ceiling panel region 12.

Figure 10:
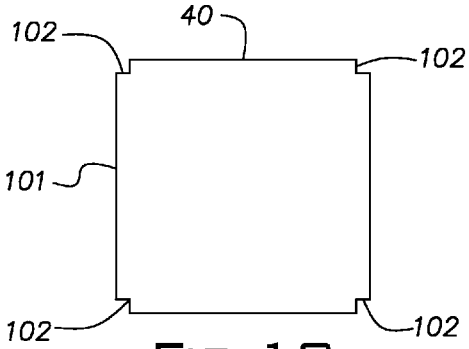
FIG. 10 comprises a plan view of a scrim as configured in accordance with various exemplary embodiments of the invention.
Figure 11:
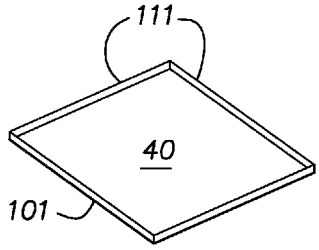
FIG. 11 comprises a perspective view of a scrim as configured in accordance with various exemplary embodiments of the invention.

Referring now to FIG. 10, there is illustrated another exemplary embodiment. In this embodiment, the thin flexible scrim 40 comprises a scrim 101 having a notch 102 formed in each corner thereof. This notch 102 can assume any of a variety of shapes, such as, for example, a square shape. As illustrated in FIG. 11, the notches 102 make it easier to bend the edges of the scrim 101 upwards to form corresponding upturned edge lips 111 or walls. If desired, the scrim 101 can be pre-scored or the like to make it easier to form these upturned edge lips 111. Such walls, if maintained, can provide the desired rigidity.

Figure 12:
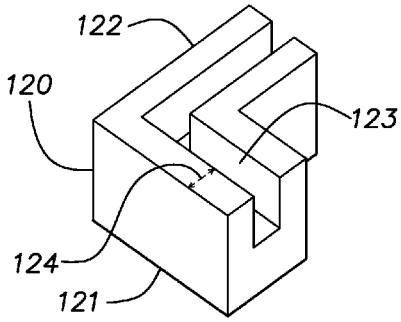
FIG. 12 comprises a bottom perspective view of a clip as configured in accordance with various embodiments of the invention.

To maintain the configuration of the upturned edge lips 111, a rigidizing and engagement member comprising a clip 120 (as illustrated, for example, in FIG. 12) can serve to facilitate maintaining at least two of these upturned edge lips 111. In the illustrative example shown, such a clip 120 can comprise an "L" shaped part having a first leg 121 and a second leg 122 that join one another at a substantially 90 degree angle. These legs 121 and 122 have a notch 123 formed therein that is sized and configured to receive the aforementioned upturned edge lips 111 of the scrim 101. By one approach this can comprise a compression fit. Using the design shown, each such clip 120 can accommodate two upturned edge lips 111 to form a corner of the corresponding ceiling tile.

Figure 13:
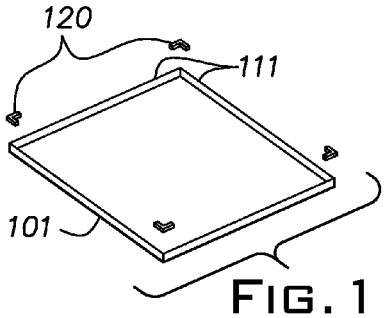
FIG. 13 comprises an exploded perspective view of a scrim as configured in accordance with various exemplary embodiments of the invention.
Figure 14:
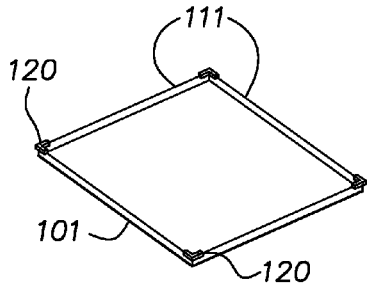
FIG. 14 comprises a perspective view of a scrim as configured in accordance with various exemplary embodiments of the invention.

Referring now to FIGS. 13 and 14, by one approach four such clips 120 can then be placed at each corner of the scrim 101 to thereby each captivate two endpoints of two upturned edge lips 111 and thereby aid in maintaining those upturned edge lips in the deployed position. By this approach, there are a sufficient number of the clips 120 such that each of the upturned edge lips 111 are engaged by at least two of the clips 120. This, in turn, provides sufficient rigidity to consistently maintain a substantially planar form for the scrim 101 notwithstanding the thin and flexible nature of the scrim 101.

As noted, the notch 123 in the clip 120 can provide a compression fit at the corners of the scrim 101. By another approach, if desired, such clips 120 can be retained in position by other means. Examples in this regard include, but are not limited to, adhesives, crimps, springs or other biasing members, and transversal securement members such as bolts, screws, staples, brads, or the like, to note but a few examples in this regard. The clips 120 themselves can be formed of any suitable material including, but not limited to, plastics of various kinds, metal (such as aluminum), rubber and rubber-like materials, and so forth.

Figure 15:
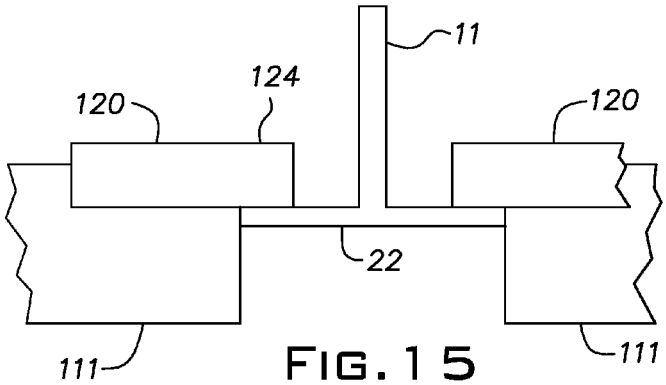
FIG. 15 comprises a side elevational cutaway view of a portion of a ceiling system as configured in accordance with various exemplary embodiments of the invention.

Referring again to FIG. 12, such clips 120 can also be configured and arranged to have an outwardly extending portion 124 that can engage a grid runner in a desired manner. Such an outwardly extending portion 124 can be on only one leg of the clip or can be on both legs as desired. Referring now to FIG. 15, which depicts a grid runner 11 that engages two such clips 120 for two discrete ceiling panels, this outwardly extending portion 124 rests on a corresponding surface 22 of the grid runner 11. Those skilled in the art will recognize that when both legs of the clip 120 have such an outwardly extending portion, a single such clip 120 can rest atop two adjoining grid runners.

So configured, such a rigidizing and engagement member serves to facilitate maintaining the upturned edge lips of a scrim to remain in a deployed manner to thereby aid the scrim to consistently maintain a substantially planar form when installed in a grid-type suspended ceiling. At the same time, these rigidizing and engagement members also serve to engage the grid runners of the ceiling system to maintain the scrim in an installed position within the grid-type suspended ceiling.

Figure 16:
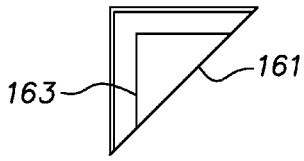
FIG. 16 comprises a plan view of a clip as configured in accordance with various exemplary embodiments of the invention.
Figure 17:
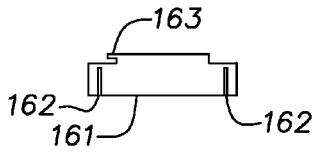
FIG. 17 comprises a front elevational view as corresponds to FIG. 16 in accordance with various exemplary embodiments of the invention.
Figure 18:
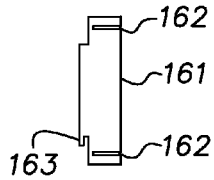
FIG. 18 comprises a side elevational view as corresponds to FIG. 16 in accordance with various exemplary embodiments of the invention.

Variations on the form of the clip 161 form are certainly possible. As but one of many examples in this regard, and referring now to FIGS. 16, 17, and 18, another clip 161 can have a generally triangular shape that again accommodates slots 162 that are positioned and sized to again engage the upturned edge lips 111 of the scrim 101 substantially as described above. As yet another variation, and with continued reference to these figures, instead of an outwardly extending portion 124 as was described above, the clip 161 can have an overhanging portion 163 that is sized to again accommodate a grid runner in a manner that aids in securing the position of the resultant ceiling panel with respect to that grid runner.

Figure 19:
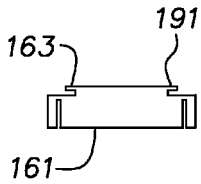
FIG. 19 comprises a front elevational view as corresponds to FIG. 16 in accordance with various exemplary embodiments of the invention.
Figure 20:
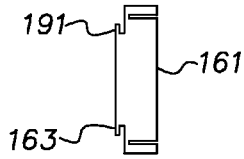
FIG. 20 comprises a side elevational view as corresponds to FIG. 16 in accordance with various exemplary embodiments of the invention.

In the example shown, each clip 161 has such an overhanging portion 163 along one side thereof. If desired, and referring now to FIGS. 19 and 20, an additional overhanging portion 191 can be disposed along another side of the clip 161. Such a configuration will make it possible for such a clip 161 to appropriately engage two grid runners that are disposed substantially normal to one another.

Figure 21:
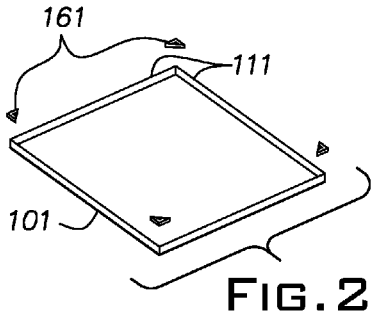
FIG. 21 comprises an exploded perspective view of a scrim as configured in accordance with various exemplary embodiments of the invention.
Figure 22:
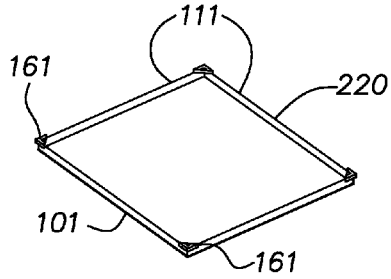
FIG. 22 comprises a top perspective view of a scrim as configured in accordance with various embodiments of the invention.

As shown in FIGS. 21 and 22, these triangular shaped clips 161 can be disposed in the corners of the scrim 101 in order to engage the upturned edge lips 111 within the above-described slots 162. As before, these clips 161 can be secured in place using any of a variety of attachment schemes. These clips 161 serve to facilitate maintaining the desired amount of rigidity to the scrim 101 and hence to the resultant ceiling panel 220.

Figure 23:
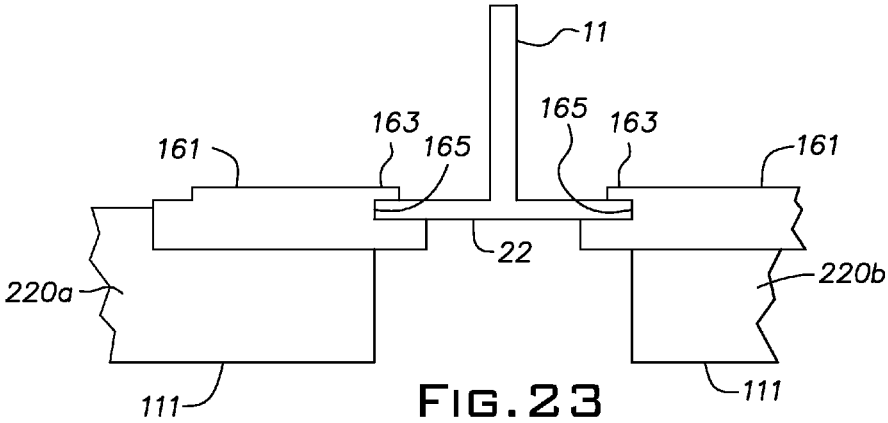
FIG. 23 comprises a side elevational cutaway view of a portion of ceiling system as configured in accordance with various exemplary embodiments of the invention.
Figure 24:
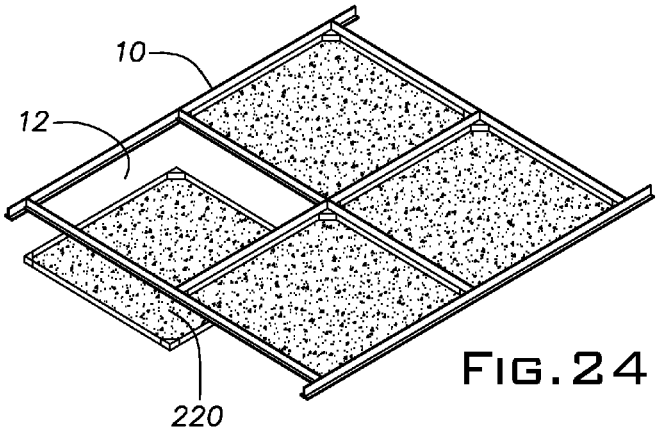
FIG. 24 comprises a top perspective view of a portion of a ceiling system as configured in accordance with various exemplary embodiments of the invention.

Referring now to FIG. 23, two ceiling panels 220*a* and 220*b* are shown in an installed state. The horizontal surfaces 22 of the grid runner 11 are seen to be disposed, in part, beneath the above described overhanging portions 163. That is, the overhanging portions 163 form a groove 165, with the base of the clips. The flange of the grid runner is received, at least in part, in the groove. So positioned, the ceiling panels 220*a* and 220*b* will tend to remain in place as shown. FIG. 24, in turn, illustrates a number of installed ceiling panels of this sort. When installing such a ceiling panel 220, it may be useful to slightly and temporarily bow the ceiling panel 220 in both an X and a Y direction in order to fit the ceiling panel 220 within the ceiling panel region 12.

Those skilled in the art will recognize that a wide variety of modifications, alterations, and combinations can be made with respect to the above described embodiments without departing from the spirit and scope of the invention, and that such modifications, alterations, and combinations are to be viewed as being within the ambit of the inventive concept.

What is claimed is:

1. A ceiling panel for use in a suspended ceiling grid, wherein the suspended ceiling grid comprises a plurality of spaced grid runners forming rectangular spaces, the ceiling panel comprising:

a flexible scrim having a plurality of deployable upturned edge lips;

a plurality of clips that that each engage and hold adjacent ends of two of the plurality of deployable upturned edge lips in a deployed manner, each of the plurality of clips forming a separate corner, wherein each of the plurality of clips is further configured and arranged to engage at least one of the plurality of spaced grid runners to thereby maintain the flexible scrim in an installed position within the suspended ceiling grid; and wherein the flexible scrim without the plurality of clips is of insufficient rigidity to maintain a planar form without sagging but the flexible scrim when maintained in the deployed manner by the plurality of clips achieves a sufficient rigidity to maintain planar form without sagging.

2. The panel of claim 1, wherein each of the plurality of clips is further configured and arranged to engage at least one of the plurality of spaced grid runners by resting on the at least one of the plurality of spaced grid runners.

3. The panel of claim 2, wherein each of the plurality of clips is further configured and arranged to simultaneously engage at least two of the plurality of spaced grid runners by resting on the at least two plurality of spaced grid runners.

4. The panel of claim 1, wherein each of the plurality of clips comprises a slot configured and arranged to receive a portion of the at least one of the plurality of spaced grid runner.

5. The panel of claim 4, wherein each of the plurality of clips comprises at least two slots that are configured and arranged to each receive a portion of a different one of the plurality of spaced grid runners.

6. The panel of claim 5, wherein the at least two slots are disposed substantially normal to one another.

* * * * *

UNITED STATES PATENT AND TRADEMARK OFFICE

CERTIFICATE OF CORRECTION

PATENT NO. : 8,646,238 B2
APPLICATION NO. : 13/334092
DATED : February 11, 2014
INVENTOR(S) : Peder J. Gulbrandsen It is certified that error appears in the above-identified patent and that said Letters Patent is hereby corrected as shown below:

In the Claims:

Column 8, line 42 (Claim 3, line 4), before “plurality” insert --of the--.

Signed and Sealed this
Twenty-seventh Day of May, 2014

Michelle K. Lee

Michelle K. Lee
*Deputy Director of the United States Patent and Trademark Office*